US006505583B2

(12) United States Patent
Matsuda et al.

(10) Patent No.: US 6,505,583 B2
(45) Date of Patent: Jan. 14, 2003

(54) FUEL CONTROLLING APPARATUS FOR INTERNAL COMBUSTION ENGINE

(75) Inventors: Yoshimoto Matsuda, Kobe (JP); Yoji Fukami, Kakogawa (JP); Satoru Watabe, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/796,482

(22) Filed: Mar. 2, 2001

(65) Prior Publication Data

US 2001/0018900 A1 Sep. 6, 2001

(30) Foreign Application Priority Data

Mar. 3, 2000 (JP) ..... 2000-58660

(51) Int. Cl.[7] ..... F02M 7/00; F02M 9/02

(52) U.S. Cl. ..... 123/73 C; 123/73 A

(58) Field of Search ..... 123/73 C, 436, 123/299, 300, 295, 73 A, 73 AD, 73 PP, 198 DB

(56) References Cited

U.S. PATENT DOCUMENTS 4,462,346 A * 7/1984 Haman et al. ..... 123/73 A
4,625,688 A * 12/1986 Takayasu ..... 123/73 B
5,092,287 A * 3/1992 Motoyama et al. ..... 123/73 A
5,138,984 A * 8/1992 Takashima ..... 123/73 A
5,353,759 A * 10/1994 Abe et al. ..... 123/79.15
5,503,119 A * 4/1996 Glover ..... 123/73 B
5,749,338 A * 5/1998 Gohara et al. ..... 123/73 A
6,062,179 A * 5/2000 Gohara et al. ..... 123/73 A
6,065,442 A * 5/2000 Motose et al. ..... 123/294
6,227,165 B1 * 5/2001 Motose et al. ..... 123/305
6,354,277 B1 * 3/2002 Kato ..... 123/492

FOREIGN PATENT DOCUMENTS

JP A 8-296523 11/1996
JP 68073 * 3/1997 ..... F02D/41/10
JP 248473 * 9/2001 ..... F02D/41/10

* cited by examiner

*Primary Examiner*—Tony M. Argenbright
*Assistant Examiner*—Hai H. Huynh
(74) *Attorney, Agent, or Firm*—Oliff & Berridge, PLC

(57) ABSTRACT

A fuel controlling apparatus includes: a fuel injector, the fuel injector being controlled on a basis of a throttle opening degree and an engine speed without measuring a quantity of an intake air; and a carburetor that supplies the fuel to the engine using a negative pressure produced by the intake system of the engine. The fuel is supplied to the engine solely by the fuel injector while the engine speed is lower than a lower limit of a high engine speed range including an upper limit engine speed. The fuel is supplied to the engine by both the fuel injector and the carburetor so that the fuel of a necessary quantity is supplied to the engine by combining a quantity of the fuel supplied by the fuel injector and a quantity of the fuel supplied by the carburetor while the engine speed is in the high engine speed range.

7 Claims, 6 Drawing Sheets

FUEL CONTROLLING APPARATUS FOR INTERNAL COMBUSTION ENGINE

BACKGROUND OF THE INVENTION

1. Field of the Invention

The present invention relates to a fuel controlling apparatus for an internal combustion engine provided with a fuel injector and, more particularly, to a fuel controlling apparatus for an internal combustion engine for transportation equipment, such as small planing boats, snowmobiles or motorcycles for motocross.

2. Description of the Related Art

FIG. 1 shows a small planing boat as an example of transportation equipment mounted with an internal combustion engine to which the present invention may be applied. The construction of a general small planing boat will be explained with reference to FIG. 1. The small planing boat has a body including a hull 1 and a deck 2. A saddle seat 3 and a handlebar 4 are supported on the deck 2. A water-jet propulsion unit 8 is disposed in a rear portion of the hull 1. The water-jet propulsion unit 8 includes a duct 9, guide vanes (current plates) 15, a jet nozzle 5 and an impeller 7. A laterally swingable steering nozzle 13 is disposed behind the jet nozzle 5. The impeller 7 is housed in the duct 9 and is mounted on an impeller shaft (drive shaft) 10. The impeller shaft 10 is coupled with the output shaft of an engine 11 supported on the hull 1. A rear end portion of the impeller shaft 10 is supported for rotation in a bearing housed in a bearing case 15a held on the guide vanes 15. When the impeller 7 is rotated, water is sucked through a water inlet 12 formed in the bottom of the hull 1 into the duct 9, flows through the guide vanes 15 and the jet nozzle 5 and is jetted out through the rear end opening 13*a* of the steering nozzle 13.

Generally speaking, an engine of transportation equipment may be provided with a carburetor. However, the engine 11 mounted on the small planing boat shown in FIG. 1 is provided with a fuel injector 14 because the fuel injector 14 enables precise fuel injection timing control.

The fuel injection operation of the engine 11 provided with the fuel injector 14 is controlled by, for example, an $\alpha$N control mode. The $\alpha$N control mode measures throttle opening $\alpha$ and engine speed N, selects an optimum injection quantity of fuel from a map stored beforehand in a controller on the basis of the values of throttle opening $\alpha$ and engine speed N, and adjusts the injection duration and the opening of the fuel injector. An overspeed limiting device prevents the operation of the engine at engine speeds exceeding an upper limit engine speed by cutting ignition and/or cutting down fuel.

Some times, it is difficult to determine an appropriate injection quantity for an air demand in an engine in case that fuel injection is controlled by $\alpha$N control, especially in case that fuel injection is controlled by $\alpha$N control and overspeed is limited by, for example, cutting ignition, because of the following reasons.

In most cases, the small planing boat planes over waves. The engine operates under no load when the water inlet 12 of the water jet propulsion unit 8 emerges from water and operates under load when the water inlet 12 is immersed in water. Consequently, no-load running and loaded running are repeated in a short time.

When the engine is controlled for overspeed limiting that cuts ignition, an engine speed repeatedly exceeds an upper limit engine speed at a high frequency in a short time due to the repetition of no-load running and loaded running while the small planing boat is planing over waves with the engine operating at engine speeds near the upper limit engine speed. Consequently, combustion and misfire are repeated. The repetition of combustion and misfire causes the pulsation of the exhaust and the variation of scavenging efficiency entailing the variation of air demand. However, it is difficult for $\alpha$N control to determine air demand accurately and hence it is difficult to set a fuel quantity properly.

An optimum air-fuel ratio can be determined by setting a fuel injection quantity for a measured air demand which is measured by an air flowmeter. However, the air flowmeter is expensive. Moreover, a valve type flowmeter is not preferable because the valve cover of the valve type flowmeter exerts resistance on intake air and the controllability of the engine is deteriorated.

SUMMARY OF THE INVENTION

Accordingly, it is an object of the present invention to stabilize combustion in an internal combustion engine provided with a fuel injector by properly injecting fuel according to air demand particularly while the internal combustion engine is operating at engine speeds near an upper limit engine speed and the actual engine speed frequently exceeds the upper limit engine speed.

According to one aspect of the present invention, a fuel controlling apparatus of an internal combustion engine for controlling a quantity of a fuel that is supplied to the engine includes a fuel injector that injects the fuel to the engine, the fuel injector being controlled on a basis of a throttle opening degree and an engine speed without measuring a quantity of an intake air that is taken through an intake system of the engine; and a carburetor that supplies the fuel to the engine using a negative pressure produced by the intake system of the engine. The fuel is supplied to the engine solely by the fuel injector while the engine speed is lower than a lower limit of a high engine speed range including an upper limit engine speed. The fuel is supplied to the engine by both the fuel injector and the carburetor so that the fuel of a necessary quantity is supplied to the engine by combining a quantity of the fuel supplied by the fuel injector and a quantity of the fuel supplied by the carburetor while the engine speed is in the high engine speed range.

Preferably, the lower limit of the high engine speed range varies in accordance with the throttle opening degree.

Preferably, the fuel controlling apparatus further includes an engine controller storing a map of an optimum fuel injection quantity as a function of the throttle opening degree and the engine speed. The fuel injector is controlled by the engine controller with reference to the map in accordance with the throttle opening degree and the engine speed.

Preferably, the carburetor does not operate in an entire range of the engine speed when the throttle opening degree is below about 50%.

Preferably, a ratio between the quantity of the fuel fed by the fuel injector and the quantity of the fuel fed by the carburetor is in a range of about 7:3 to about 5:5 when the throttle opening degree is 100%.

Preferably, the fuel controlling apparatus further includes an overspeed limiting device that stops or suppresses a combustion when the engine speed exceeds the upper limit engine speed.

Preferably, the carburetor is a piston type variable-venturi carburetor.

Preferably, the carburetor is an electromagnetic carburetor having a fuel jet nozzle controlled by a solenoid valve.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Figure 1:
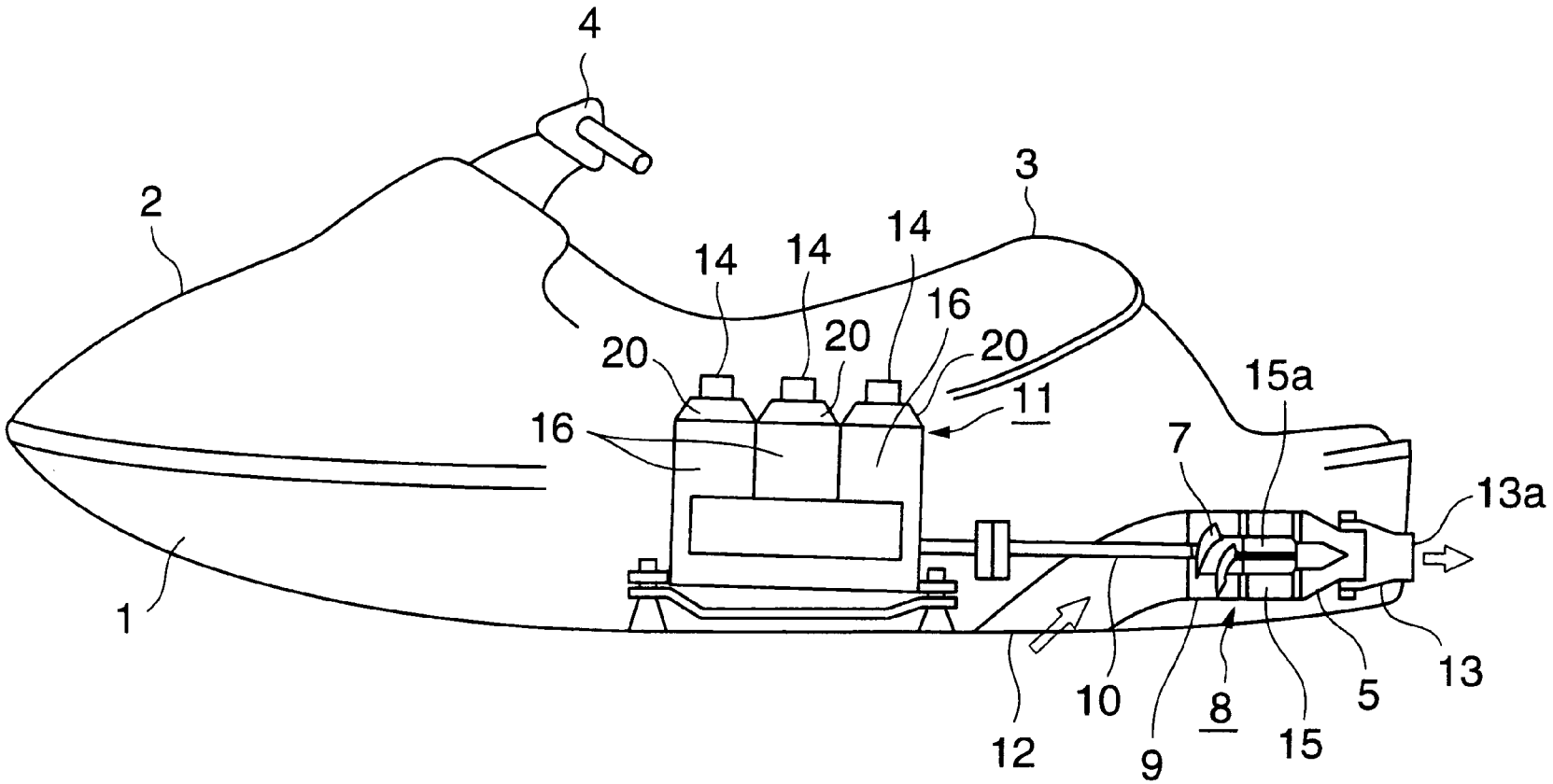
FIG. 1 is a side elevation of a small planing boat provided with an internal combustion engine to which the present invention may be applied.
Figure 2:
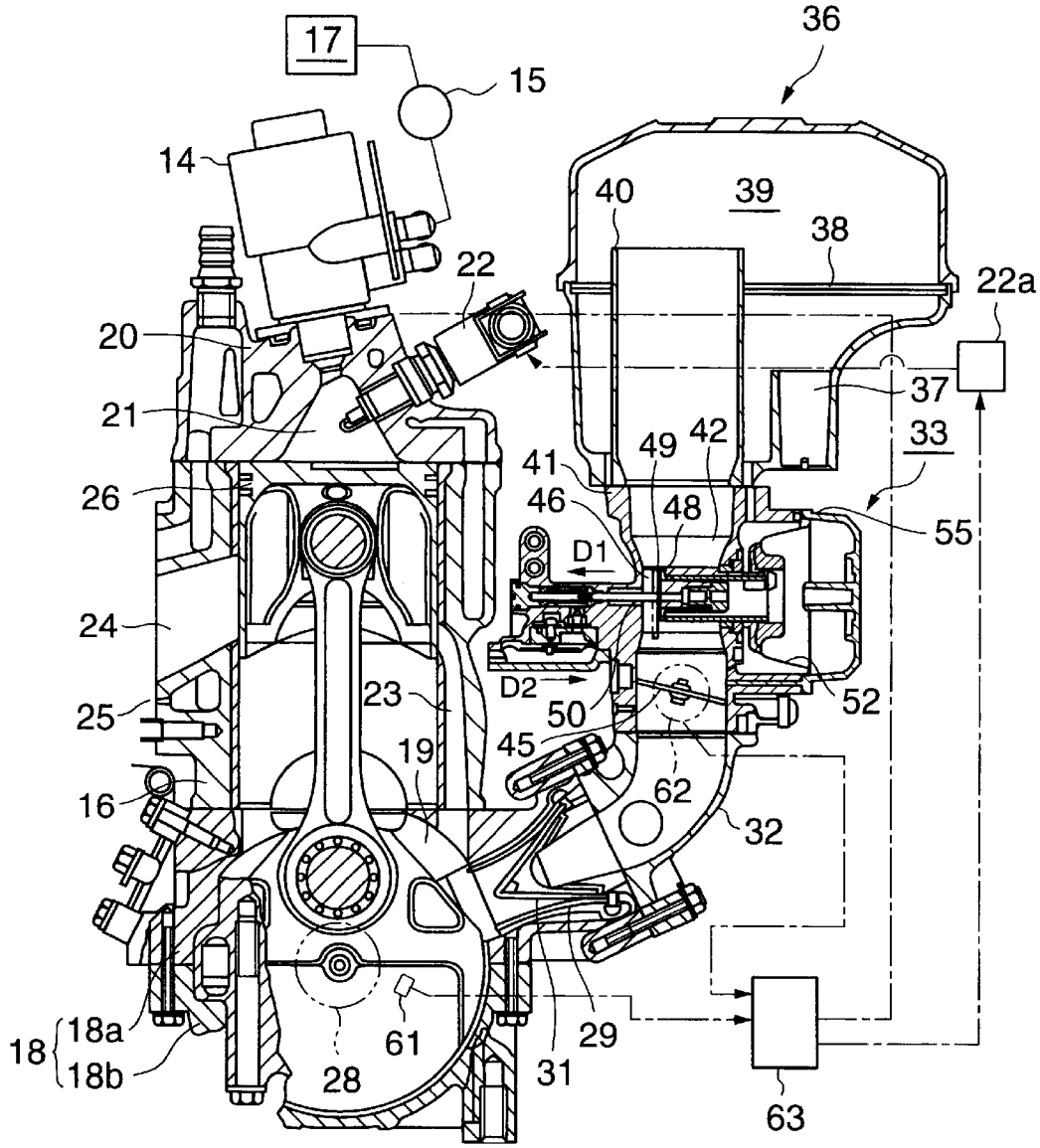
FIG. 2 is a vertical sectional view of a cylinder direct injection type two-cycle engine provided with a fuel controlling apparatus in a first embodiment according to the present invention.
Figure 3:
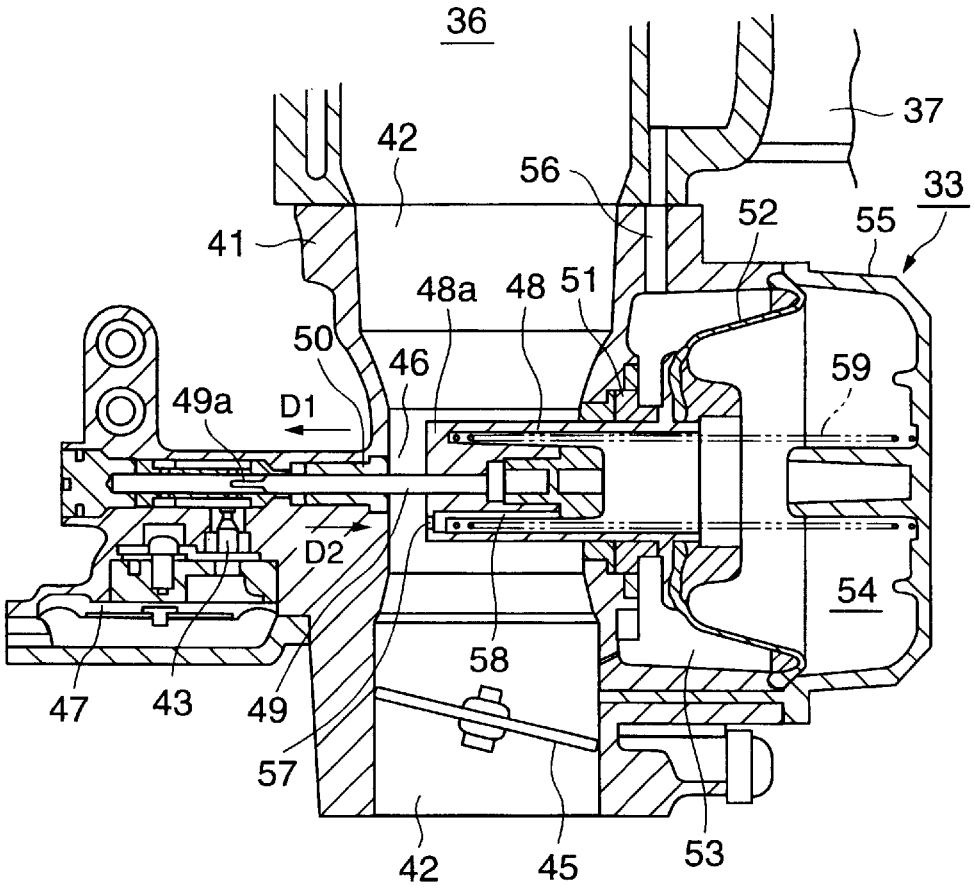
FIG. 3 is an enlarged vertical sectional view of a piston type variable-venturi carburetor shown in FIG. 2.
Figure 4:
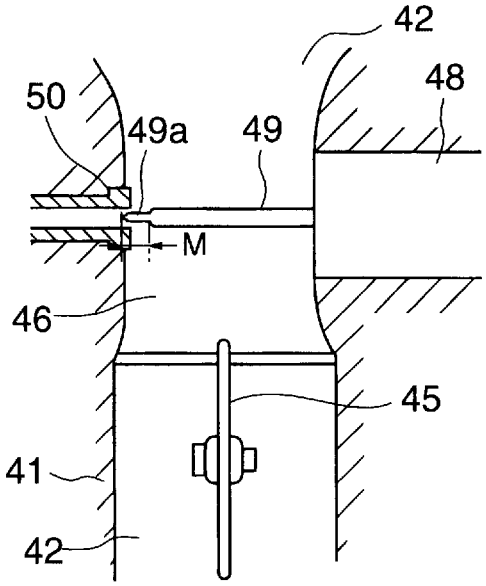
FIG. 4 is a fragmentary sectional view of the piston type variable-venturi carburetor shown in FIG. 3 in a state where a needle jet is fully opened.

FIGS. 2 to 4 show an engine provided with a fuel controlling apparatus in a first embodiment according to the present invention The engine shown in FIGS. 2 to 4 can be mounted on the small planing boat shown in FIG. 1. The engine is a cylinder direct injection type three-cylinder two-cycle engine which is provided with cylinder direct injection type fuel injectors 14. Referring to FIG. 2 showing one of the cylinders 16 of the engine, a cylinder head 20 and a crankcase 18 are fastened to the upper and the lower end of the cylinder 16, respectively. The fuel injector 14 and a spark plug 22 are mounted on the cylinder head 20. The fuel injector 14 is attached to an upper portion of the cylinder head 20 so as to face a combustion chamber 21 from above and has a fuel inlet connected through a fuel pump 15 to a fuel tank 17. The spark plug 22 projects obliquely downward into the combustion chamber 22 and is connected to an ignition system 22*a*.

A piston 26 is fitted in the cylinder bore of the cylinder 16. The cylinder 16 is provided with an exhaust port 24 and a scavenging passage 23. An exhaust manifold 25 is connected to the exhaust port 24. The scavenging passage 23 opens in the side wall of the cylinder 16 and communicates with a crank chamber 19 defined by the crankcase 18. The crankcase 18 has an upper half case 18*a* and a lower half case 18*b*. The crankcase 18 supports a crankshaft 28 for rotation in the crank chamber 19. An intake port member 29 is formed integrally with the crank case 18. A reed valve assembly 31 is fitted in the intake port member 29. An intake pipe 32 is joined to the end surface of the intake port member 29.

A piston type variable-venturi carburetor 33 provided with a diaphragm 52 is connected to the upper end of the intake pipe 32, and an air intake case 36 is connected to the upper end of the carburetor 33. Air is taken from an air inlet 37 opening downward through a flame arrester 38 into an air chamber 39 of the air intake case 36 and is supplied through a vertical outlet pipe 40 into the suction passage 42 of the carburetor 33. The basic construction of the carburetor 33 is the same as that of the well-known piston-type variable-venturi carburetor. The carburetor 33 is provided with only a main needle jet 50 and is not provided with any jet corresponding to a slow jet which, in general, is formed near a throttle valve 45. The suction passage 42 of the carburetor 33 extends vertically through a carburetor body 41. The throttle valve 45 is supported pivotally in a lower portion of the suction passage 42 on the carburetor body 41. An operating member is connected to the throttle valve 45. A piston 48 is disposed in a venturi bore 46 of the suction passage 42 above the throttle valve 45 with respect to the flowing direction of intake air. The piston 48 is moved into and retracted from the suction passage 42 to vary the sectional area of the space in the venturi bore 46. A jet needle 49 is fixed to the piston 48. The jet needle 49 is extended in the direction of the arrow D1, i.e., a piston advancing direction, and is inserted in the needle jet 50 opening into the venturi bore 46.

Referring to FIG. 3 showing the carburetor 33 in an enlarged vertical sectional view, a cover 55 is attached to the end surface of a cylindrical part formed on a portion of the carburetor body 41 to define a piston operating chamber. A flange of the diaphragm 52 is held between the end surface of the cylindrical part of the carburetor body 41 and the cover 55 to divide the piston operating chamber into an atmospheric pressure chamber 53 and a negative pressure chamber 54. A compression coil spring 59 is extended between the piston 48 and the cover 55 to bias the piston 48 in the direction of the arrow D1 so that the sectional area of the space in the venturi bore 46 is reduced. One end of the piston 48 on the side of the cover 55 is connected to the diaphragm 52. The atmospheric pressure chamber 53 communicates with the external air by means of a connecting hole 56 and the air inlet 37 of the air intake case 36. The negative pressure chamber 54 communicates with a downstream region of a space in the venturi bore 46 by means of a longitudinal groove 58 formed in the piston 48 and a suction port 57 formed in the end wall 48a of the piston 48. A negative pressure produced in the downstream region of the space in the venturi bore 46 prevails in the negative pressure chamber 54.

The piston 48 is moved in the directions of the arrow D1 or D2 depending on the balance of the pressure difference between the pressures in the atmospheric pressure chamber 53 and the negative pressure chamber 54 and the resilience of the compression coil spring 59 to adjust the sectional area of the space in the venturi bore 46.

The needle jet 50 is connected through a needle valve 43 and a diaphragm pump chamber 47 to a fuel source. Referring to FIG. 4, the length of the jet needle 49 is determined so that the needle jet 50 is fully opened in a state shown in FIG. 4 when the piston 48 is fully retracted. A reduced part 49*a* of a length M is formed integrally with the jet needle 49 so as to extend from the free end of the jet needle 49. The reduced part 49*a* is drawn out of the needle jet 50 to open the needle jet 50 gradually before the piston 48 is fully retracted, so that fuel is sucked through the needle jet 50 into the venturi bore 46.

The time when the needle jet 50 starts opening is dependent not only on engine speed but also on the respectively lengths of the jet needle 49 and the reduced part 49*a*. The respective lengths of the jet needle 49 and the reduced part 49*a* are determined so that the needle jet 50 starts opening when the engine speed increases beyond a carburetor function starting engine speed Ns1 for a throttle opening degrees of 100%, a carburetor function starting engine speed Ns2 for a throttle opening degree of 75% or a carburetor function starting engine speed Ns3 for a throttle opening degree of 50. The carburetor function starting engine speeds Ns1, Ns2 and Ns3 are slightly lower than a peak engine speed Np and near an upper limit engine speed N0. The displacement of the piston 48 that moves together with the jet needle 49 is dependent on the flow rate of air flowing through the venturi bore 46, i.e., negative pressure in the venturi bore 46. Therefore, the carburetor function starting engine speed at which the needle jet 50 starts opening are Ns1, Ns2 and Ns3 for different throttle opening degrees, respectively.

Referring again to FIG. 2, an αN controller for the αN control of fuel injection quantity, i.e., the quantity of fuel to be injected by the fuel injector 14, includes an engine speed measuring device 61 that measures the rotating speed of the crankshaft 28, a throttle sensor 62 for measuring throttle opening degree, i.e., the opening degree of the throttle valve 45, and a engine controller 63 including a computer. A map of optimum fuel injection quantity as a function of throttle opening degree a and engine speed N is stored in the engine controller 63. Fuel injecting duration for which the fuel injector 14 injects fuel and fuel injection rate at which the fuel injector 14 injects fuel are adjusted with reference to the map according to throttle opening degree a and engine speed N. The fuel injector 14 operates in the entire engine speed range. The fuel injector 14 injects fuel at fuel injection quantities smaller than that demanded by the engine at engine speeds higher than the carburetor function starting engine speeds Ns1, Ns2 and Ns3 (FIG. 5) at which the carburetor 33 starts feeding fuel.

The overspeed limiting device is included in the engine controller 63. When the engine speed measured by the engine speed measuring device 61 exceeds the upper limit engine speed NO, for example, the over speed limiting device gives a misfire signal to the ignition system 22*a* that makes the spark plug 22 produce a spark and, at the same time, closes the fuel passages of the fuel injector 14 and the carburetor 33 to cut off fuel feed.

Figure 5:
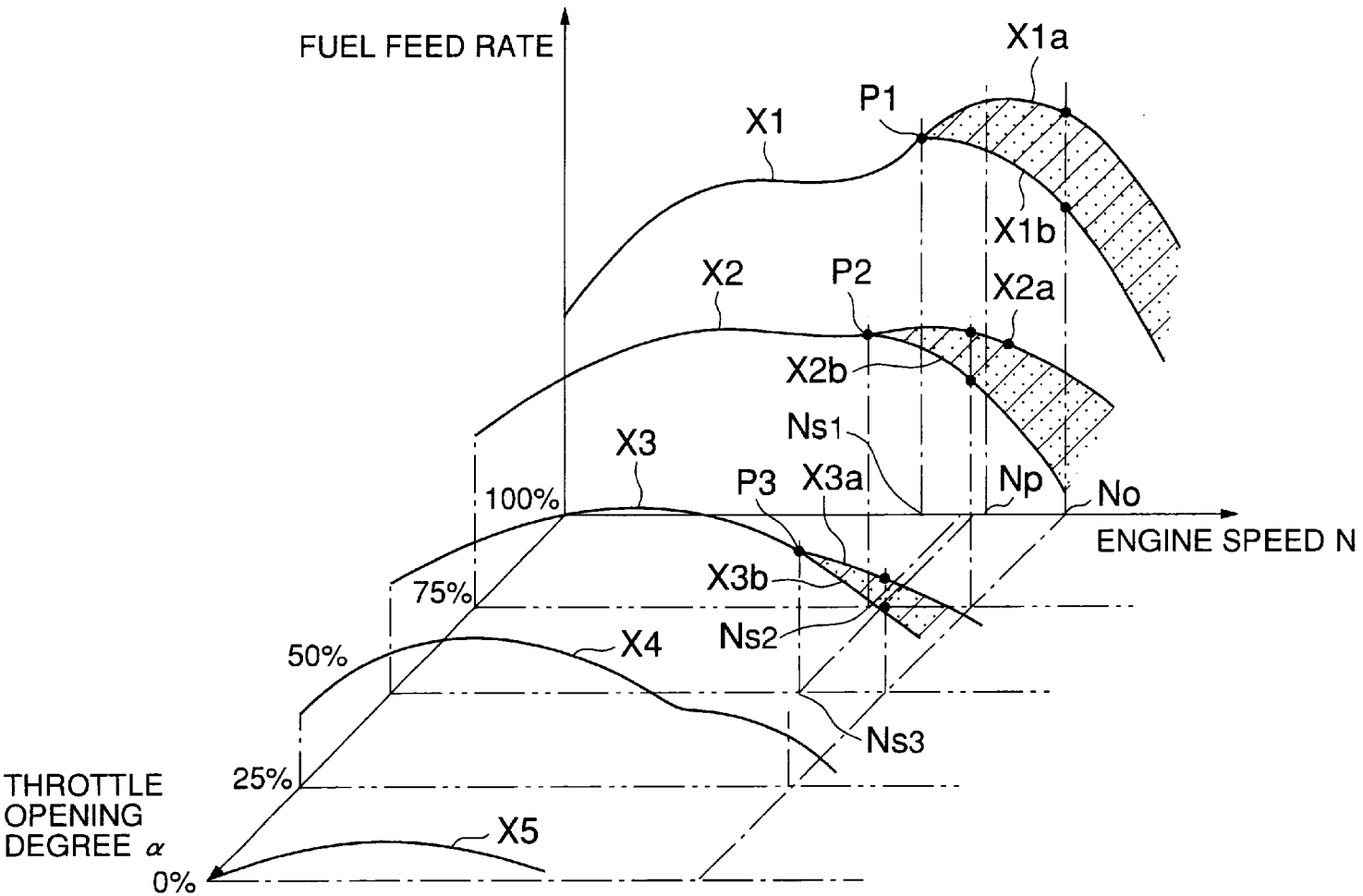
FIG. 5 is a three-dimensional graph showing the relation between fuel feed rate, engine speed and throttle opening degree when the engine is controlled by the fuel controlling apparatus of the present invention.

FIG. 5 shows the relation between fuel feed rate, engine speed and throttle opening degree. Curves X1, X2, X3, X4 and X5 indicate the variation of fuel feed rate with engine speed when throttle opening degree is 100%, 75%, 50%, 25% and 0%, respectively. Points P1, P2 and P3 on the curves X1, X2 and X3 correspond to engine speeds, respectively, at which the carburetor 33 starts feeding fuel. The ranges of the engine speed above the respective points P1, P2 and P3 are defined as high engine speed ranges. While the engine is operating at engine speeds below the engine speeds corresponding to the points P1 P2 and P3, fuel is feed only by the fuel injector 14. While the engine is operating at engine speeds above the engine speeds corresponding to the points P1, P2 and P3, fuel is feed by both the fuel injector 14 and the carburetor 33, in which the quantity of fuel injected by the fuel injector 14 is smaller by a fixed quantity than normal fuel demands X1*a*, X2*a* and X3*a* indicated by curves X1*b*, X2*b* and X3*b*. A quantity of fuel indicated by shaded portions in FIG. 5 is supplied by the carburetor 33 to meet the normal fuel demands X1*a*, X2*a* and X3*a*.

It is preferable that the carburetor 33 operates when the throttle opening degree is in the range of 100% to about 50% and does not operate when the throttle opening degree is below about 50%. It is preferable that the ratio between the quantity of fuel fed by the fuel injector 14 and that fed by the carburetor 33 is in the range of about 7:3 to about 5:5 at the upper limit engine speed when the throttle opening degree 100% and fuel feed rate varies with engine speed along the curve X1.

The carburetor function starting engine speeds Ns1, Ns2 and Ns3 at which the carburetor 33 starts feeding fuel corresponding to the points P1, P2 and P3, respectively, are higher for smaller throttle opening degrees; that is, Ns1<Ns2<Ns3. All the carburetor function starting engine speeds ns1, Ns2 and Ns3 at which the carburetor 33 starts feeding fuel are near and lower than the upper limit engine speed N0, and are slightly lower than the peak engine speed Np.

Referring to FIG. 5, supposing that the throttle opening degree is 100% (curve X1), fuel is fed to the engine only by the fuel injector 14 while the engine is operating at engine speeds in the range of zero to Ns1 slightly below Np and the fuel injector 14 is controlled by an αN control mode to jet fuel at proper fuel injection quantities. When the engine speed increases beyond the carburetor function starting engine speed Ns1 (point P1), the reduced part 49*a* of the jet needle 49 starts coming out of the needle jet 50 (FIG. 3) and the carburetor 33 starts feeding fuel. The needle jet 50 is fully opened when the piston 48 is fully retracted as shown in FIG. 4 and fuel is sucked properly through the needle jet 50 according to the flow rate of air flowing through the venturi bore 46. While the engine operates at engine speeds in the high engine speed range, i.e., engine speeds exceeding the carburetor function starting engine speed Ns1, both the fuel injector 14 and the carburetor 33 feed fuel. The quantity of fuel injected by the fuel injector 14 indicated by the curve X1*b* is smaller by the quantity fed by the carburetor 33 (shaded region) than the fuel demand of the engine indicted by the curve X1*a*.

When the increase of engine speed beyond the upper limit engine speed No is detected by the engine speed measuring device 61, the engine controller 63 gives a signal for stopping ignition and/or fuel cutting (in the fuel injector 14 and the carburetor 33) to stop or suppress combustion in the engine in order to lower engine speed.

Since both the fuel injector 14 and the carburetor 33 are used while the engine is operating at engine speeds near the upper limit engine speed N0, fuel feed rate can be properly adjusted according to the quantity of intake air. In other words, fuel feed rate can be properly adjusted according to the flow of intake air by using the carburetor 33 in combination with the fuel injector 14. As a result, combustion is stabilized even if the flow of intake air varies due to the pulsation of the exhaust gas, and even if the engine repeats a no-load operation while the water inlet 12 is in the air and a loaded operation while the water inlet 12 is in water frequently in a short time while the small planing boat is planing over waves.

The operation of the carburetor 33 is the same in principle as that of the well-known piston type variable-venturi carburetor and hence the operation will be briefly described hereinafter. Referring to FIG. 3, when the throttle valve 45 is turned to reduce throttle opening degree, the flow of air that flows through the venturi bore 46 decreases. The negative pressure in the venturi bore 46 and the negative pressure chamber 54 decreases, so that the difference between the pressures in the atmospheric pressure chamber 53 and the negative pressure chamber 54 decreases below the resilience of the compression coil spring 59. Consequently, the piston 48 is moved in the direction of the arrow D1 to reduce the sectional area of the inner space of the venturi bore 46 and to close the needle jet 50 by the jet needle 49. When the throttle valve 45 is turned to increase throttle opening degree, the flow and velocity of air that flows through the venturi bore 46 increases. The negative pressure in the venturi bore 46 and the negative pressure chamber 54 increases, so that the difference between the pressures in the atmospheric pressure chamber 53 and the negative pressure chamber 54 increases beyond the resilience of the compression coil spring 59. Consequently, the piston 48 is moved against the resilience of the compression coil spring 59 in the direction of the arrow D2 to increase the sectional area of the inner space of the venturi bore 46 and to start drawing the jet needle 49 out of the needle jet 50.

A fuel controlling apparatus in a second embodiment according to the present invention will be described with reference to FIG. 6, in which parts like or corresponding to those of the fuel controlling apparatus in the first embodiment are denoted by the same reference characters and the description thereof will be omitted. The fuel controlling apparatus in the second embodiment includes a carburetor capable of feeding fuel according to the flow of intake air and is provided with a solenoid valve. A throttle body 70 provided with a throttle valve 45 is interposed between the upper end of the intake pipe 32 and the air intake case 36. A fuel feed nozzle 71 connected to a solenoid valve 72 opens into an upper region above the throttle valve 45 of a suction passage 42. The solenoid valve 72 is opened to feed fuel through the fuel feed nozzle 71 into the throttle body 70 and is closed to stop feeding fuel through the fuel feed nozzle 71. When the engine speed measuring device 61 detects the engine speed beyond the carburetor function starting engine speed Ns1 when throttle opening degree is 100%, Ns2 when throttle opening degree is 75% or Ns3 when throttle opening degree is 50%, the solenoid valve 72 is opened. The carburetor function starting engine speed can be determined for this carburetor, in which fuel feed through the fuel feed nozzle 71 is controlled by the solenoid valve 72, more directly than for the carburetor shown in FIG. 2 that uses a negative pressure in the suction passage for moving the piston 48 that moves the jet needle 49.

The present invention is not limited in its practical application to the foregoing embodiments and the following modifications are possible.

(1) The engine may be provided with a fuel feed nozzle 81 disposed so as to open into the crank chamber and a solenoid valve 82 connected to the fuel feed nozzle 81 instead of the fuel feed nozzle 71 and the solenoid valve 72 which are provided in the throttle body 70. The solenoid valve 82 is controlled to feed fuel to the fuel feed nozzle 81 and to stop feeding fuel to the fuel feed nozzle 81. Fuel can be sucked through the fuel nozzle 81 according to intake air quantity by a negative pressure produced in the crank chamber as the piston 26 moves upward.

Figure 6:
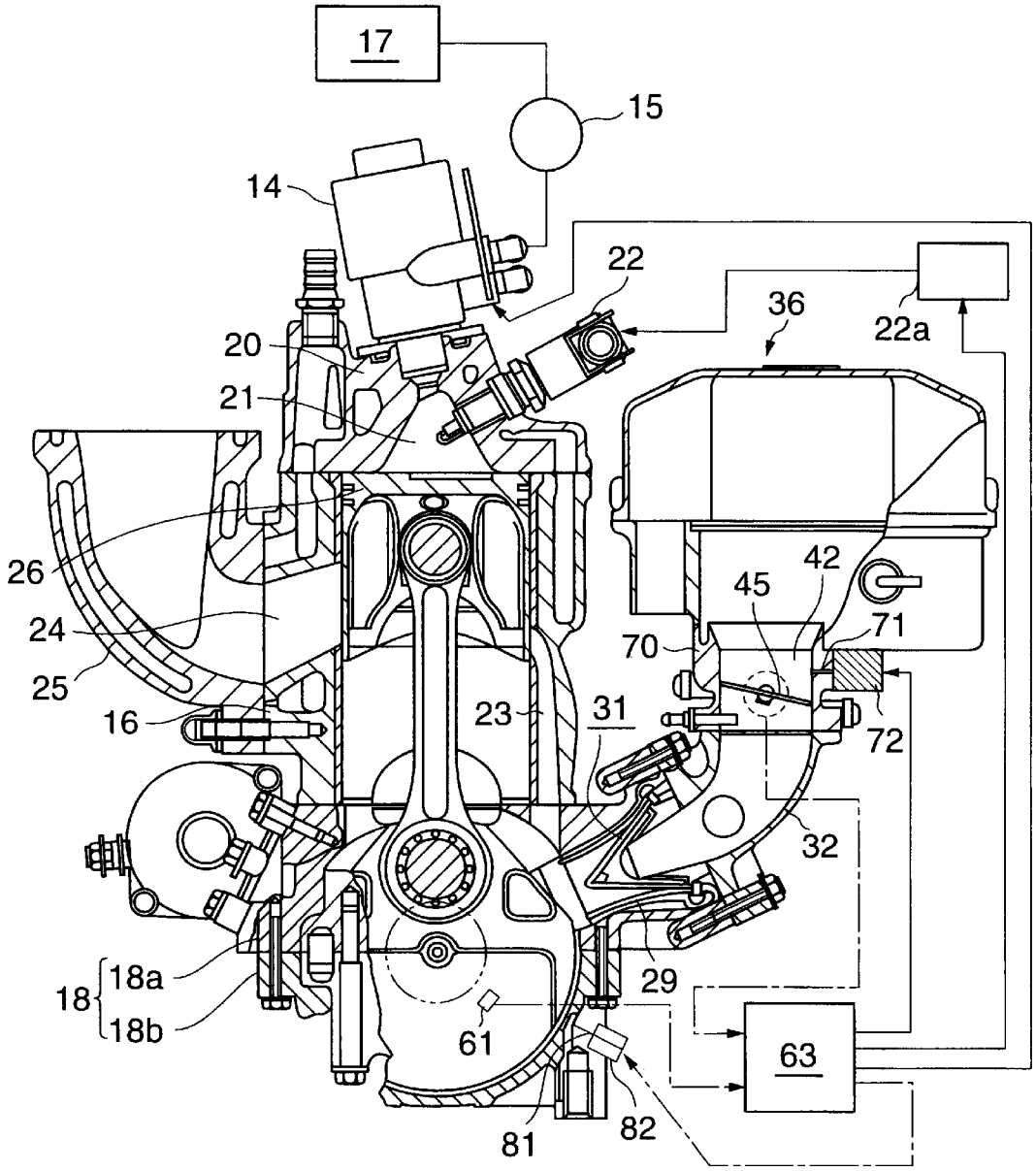
FIG. 6 is a vertical sectional view of an engine provided with a fuel controlling apparatus in a second embodiment according to the present invention.

(2) Although both the fuel controlling apparatus in the first embodiment shown in FIGS. 2 to 4 and the fuel controlling apparatus in the second embodiment shown in FIG. 6 have been described as applied to a cylinder injection type engine provided with fuel injectors, the present invention is applicable to an engine provided with a fuel injector placed in the air intake system or on the crankcase.

(3) The present invention is applicable not only to two-cycle engines but also to four-cycle engines.

Figure 7:
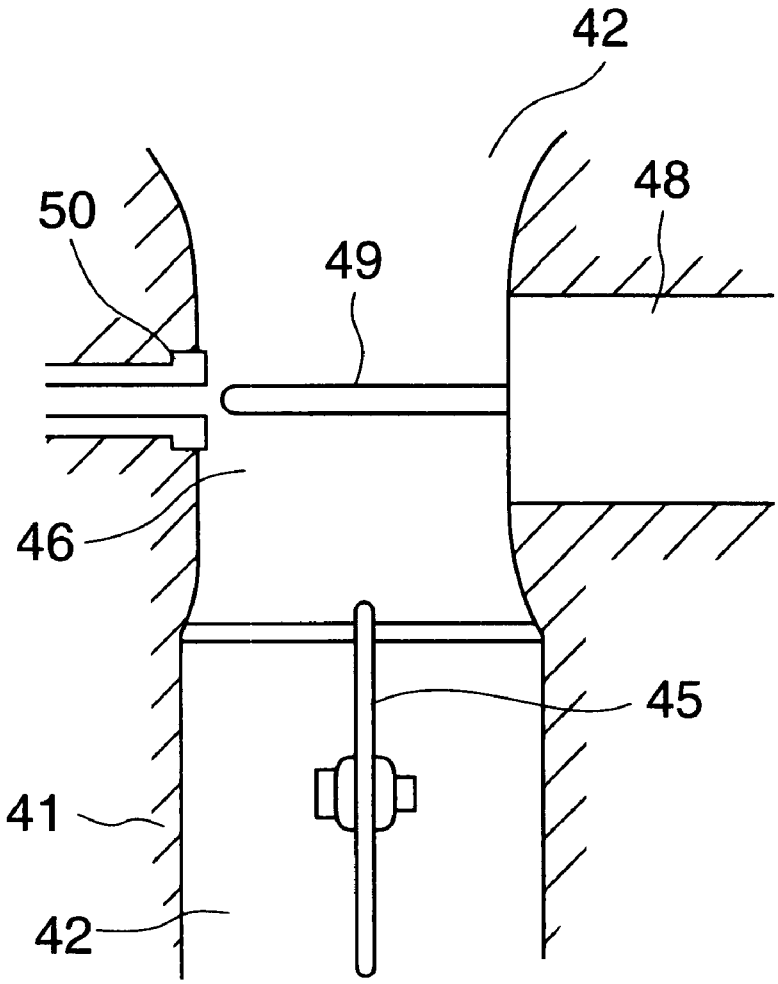
FIG. 7 is a vertical sectional view of another carburetor for the present invention.

(4) When a piston type variable-venturi carburetor similar to that shown in FIGS. 2 to 4 is employed, a jet needle 49 as shown in FIG. 7 not having any portion corresponding to the reduced part 49*a* may be used and the needle jet 50 may be opened only when the piston 48 is fully retracted.

(5) The fuel controlling apparatus of the present invention is applicable not only to engines of small planing boats but also to engines mounted on any other transportation equipment and is particularly suitable for application to engines mounted on vehicles intended for running on rough terrain, such as snow mobiles and motorcycles for motocross.

As apparent from the foregoing description, the present invention exercises the following effects.

(1) Fuel is fed only by the fuel injector, and fuel injection quantity is controlled according to engine speed and throttle opening degree while the engine is operating at engine speeds in low or middle speed range, i.e., below a high speed range including the upper limit engine speed. On the other hand, the quantity of fuel to be injected by the fuel injector is limited and both the fuel injector and the carburetor are used for feeding fuel to feed fuel properly according to air demand while the engine is operating at engine speeds in the high speed range, i.e. near the upper limit engine speed. Therefore, fuel of a correct quantity properly corresponding to a necessary air quantity can be fed by using the carburetor in combination with the fuel injector even if the engine repeats a no-load operation like the operation of the engine of a small planing boat that is performed while the water inlet is in the air and a loaded operation like the operation of the engine of a small planing boat that is performed while the water inlet is in water frequently in a short time. Consequently, combustion of the engine is stabilized while the engine is operating in engine speeds in a high engine speed range, particularly, at engine speeds near the upper limit engine speeds.

(2) In a conventional engine that is controlled by both $\alpha N$ control and overspeed suppression, it is difficult to set a proper fuel feed quantity only by $\alpha N$ control when the engine, such as an engine mounted on a small planing boat, repeats a no-load operation and a loaded operation frequently in a short time and combustion and misfiring are repeated. On the other hand, according to the present invention, since the quantity of fuel to be injected by the fuel injector is limited and fuel is supplied also by the carburetor while the engine is operating at engine speeds near the upper limit engine speed, fuel can be properly fed according to necessary air quantity and combustion in the engine is stabilized.

(3) A conventional piston type variable-venturi carburetor can be used by the present invention only by plugging up or removing the slow jet of the conventional piston type variable-venturi carburetor, in order to save parts cost.

(4) When the carburetor provided with a fuel feed nozzle opening into a portion of the air intake system in which a negative pressure is produced and controlled by a solenoid valve is employed, a carburetor function starting engine speed can be determined for this carburetor in direct relation with engine speed.

(5) When the present invention using both the fuel injector and the carburetor is applied to a two-cycle engine provided with a reed valve, the reed valve can be cooled by the fuel supplied by the carburetor while the engine is operating at engine speeds in a high engine speed range and the engine does not need any special reed valve cooling device.

(6) The fuel controlling apparatus of the present invention uses the carburetor in combination with the fuel injector and the fuel injection quantity of the fuel injector is not controlled according to intake air flow measured by an air flowmeter. Therefore any resistance that will be exerted on intake air by a valve type air flowmeter is not exerted on the flow of intake air so that the engine is able to operate smoothly and the carburetor is less costly than an air flowmeter.

Although the invention has been described in its preferred embodiments with a certain degree of particularity, obviously many changes and variations are possible therein. It is therefore to be understood that the present invention-may be practiced otherwise than as specifically described herein without departing from the scope and spirit thereof.

What is claimed is:

1. A fuel controlling apparatus of an internal combustion engine for controlling a quantity of a fuel that is supplied to the engine comprising:

a fuel injector that injects the fuel to the engine, the fuel injector being controlled on a basis of a throttle opening degree and an engine speed without measuring a quantity of an intake air that is taken through an intake system of the engine;

a carburetor that supplies the fuel to the engine using a negative pressure produced by the intake system of the engine; and an overspeed limiting device that stops or suppresses a combustion when the engine speed exceeds an upper limit engine speed;

wherein, when the engine is operated under a condition that the engine speed is near the upper limit engine speed and the throttle opening degree is above a given value, the fuel is supplied to the engine by both the fuel injector and the carburetor so that the fuel of a necessary quantity is supplied to the engine by combining a quantity of the fuel supplied by the fuel injector and a quantity of the fuel supplied by the carburetor.

2. The fuel controlling apparatus according to claim 1, wherein a starting point when the carburetor begins to supply the fuel to the engine becomes nearer to the upper limit engine speed as the throttle opening degree becomes smaller.

3. The fuel controlling apparatus according to claim 1, further comprising an engine controller storing a map of an optimum fuel injection quantity as a function of the throttle opening degree and the engine speed, wherein the fuel injector is controlled by the engine controller with reference to the map in accordance with the throttle opening degree and the engine speed.

4. The fuel controlling apparatus according to claim 1, wherein the carburetor does not operate in an entire range of the engine speed when the throttle opening degree is below about 50%.

5. The fuel controlling apparatus according to claim 1, wherein a ratio between the quantity of the fuel fed by the fuel injector and the quantity of the fuel fed by the carburetor is in a range of about 7:3 to about 5:5 at the upper limit engine speed when the throttle opening degree is 100%.

6. The fuel controlling apparatus according to claim 1, wherein the carburetor is a piston variable-venturi carburetor.

7. The fuel controlling apparatus according to claim 1, wherein the carburetor is an electromagnetic carburetor having a fuel jet nozzle controlled by a solenoid valve.

* * * * *